US006090485A

United States Patent [19]

Anderson et al.

[11] Patent Number: 6,090,485

[45] Date of Patent: Jul. 18, 2000

[54] CONTINUOUS FILAMENT YARNS

[75] Inventors: Brian Thomas Anderson, Greenville; Stephen Buckner Johnson, Wilmington; Gregory Eugene Sweet, Greenville, all of N.C.; George Vassilatos, Wilmington, Del.

[73] Assignee: E. I. du Pont de Nemours and Company, Wilmington, Del.

[21] Appl. No.: 09/174,194

[22] Filed: Oct. 16, 1998

Related U.S. Application Data

[63] Continuation-in-part of application No. 08/731,541, Oct. 16, 1996, Pat. No. 5,824,248.

[60] Provisional application No. 60/081,009, Apr. 8, 1998, abandoned.

[51] Int. Cl.[7] ..... D01F 6/92

[52] U.S. Cl. ..... 428/364; 428/394

[58] Field of Search ..... 418/364, 395

[56] References Cited

U.S. PATENT DOCUMENTS

| | | | |
|---|---|---|---|
| H1275 | 1/1994 | Duncan | 428/357 |
| 3,067,458 | 12/1962 | Dauchert | 18/8 |
| 3,336,634 | 8/1967 | Brownley et al. | 18/8 |
| 4,156,071 | 5/1979 | Knox | 526/272 |
| 4,185,062 | 1/1980 | Luzzatto | 264/176 |
| 4,204,828 | 5/1980 | Peckinpaugh et al. | 425/72 |
| 4,687,610 | 8/1987 | Vassilatos | 264/211.14 |
| 4,691,003 | 9/1987 | Sze | 528/308.1 |
| 4,702,871 | 10/1987 | Hasegawa et al. | 264/101 |
| 5,034,182 | 7/1991 | Sze | 264/555 |
| 5,104,725 | 4/1992 | Broaddus | 428/224 |
| 5,141,700 | 8/1992 | Sze | 264/555 |
| 5,182,068 | 1/1993 | Richardson | 264/210.8 |
| 5,250,245 | 10/1993 | Collins et al. | 264/103 |
| 5,288,553 | 2/1994 | Collins et al. | 428/364 |
| 5,741,587 | 4/1998 | Bennie et al. | 428/365 |

FOREIGN PATENT DOCUMENTS

| | | |
|---|---|---|
| 0 178 644 | 4/1986 | European Pat. Off. . |
| 53-70124 | 6/1978 | Japan . |
| 59-163410 | 9/1984 | Japan . |
| 2-216213 | 8/1990 | Japan . |
| 3-180508 | 8/1991 | Japan . |
| 1034166 | 6/1966 | United Kingdom . |
| WO 95/15409 | 12/1994 | WIPO . |

OTHER PUBLICATIONS

Dr. Breuer, Dr. H. Haberkorn, Dr. K. Hahn, Dr. P. Matthies, BASF AG, Ludwigshafen, Schnellspinnen von Polyamid 6.6, Chemiefasern/Textilindustrie, 42/94, 662, 664, 666, 667, 668, 669, E87–90, Sep., 1992.

W. Peschke, Akzo–Nobel Faser AG, Oberburg/D; G. Koschinek, Zimmer AG Frankfurt/D, Advanced Polyester High Speed Spinning Technology, *Chemical Fibers International* (*CFI*), 45, 276, Aug., 1995.

Henry H. George, Model of Steady–State Melt Spinning at Intermediate Take–Up Speeds, *Polymer Engineering and Science*, 22, No. 5, 292–299, Mid–Apr., 1982.

*Primary Examiner*—Newton Edwards

[57] ABSTRACT

Yarns of melt-spun polymeric filaments are rapidly quenched, whereby the filaments are cooled by quenching gas that is accelerated along the threadline by being passed through a tube of reduced dimensions with the filaments before they emerge. In particular, a yarn is produced which has an elongation to break of about 100% or more. The yarn is comprised of filaments numbering from 25 to 150. The filaments are less than 4 denier per filament and makeup yarns having low denier spread.

4 Claims, 3 Drawing Sheets

CONTINUOUS FILAMENT YARNS

CROSS-REFERENCE TO RELATED APPLICATIONS

This application is a continuation-in-part of application Ser. No. 08/731,541, filed Oct. 16, 1996, now U.S. Pat. No. 5,824,248, issued on Oct. 20, 1998, and also claims benefit of priority from Provisional Application Ser. No. 60/081,009, filed Apr. 8, 1998 now abandoned.

FIELD OF THE INVENTION

The present invention concerns yarns of poly(ethylene terephthalate) filaments, and more particularly, poly (ethylene terephthalate) filaments which are quenched after they have been extruded from a heated polymeric melt.

BACKGROUND OF THE INVENTION

The term "filament" is used herein generically, and does not necessarily exclude cut fibers (often referred to as staple), although synthetic polymers are generally prepared initially in the form of continuous polymeric filaments as they are melt-spun (extruded). Most synthetic polymeric filaments are melt-spun, i.e., they are extruded from a heated polymeric melt. This has been done for more than 50 years, since the days of W. H. Carothers, who invented nylon. Nowadays, after the freshly-extruded molten filamentary streams emerge from the spinneret, they are "quenched" by a flow of cooling gas to accelerate their hardening, so they can be wound to form a package of continuous filament yarn or otherwise processed, e.g., collected as a bundle of parallel continuous filaments for processing, e.g., as a continuous filamentary tow, for conversion, e.g., into staple or other processing.

In the 1980's, Vassilatos and Sze made significant improvements in the high-speed spinning of polymeric filaments and disclosed these and the resulting improved filaments in U.S. Pat. Nos. 4,687,610 (Vassilatos), 4,691,003, 5,034,182 (Sze and Vassilatos) and 5,141,700 (Sze). These Patents disclose gas management techniques, whereby gas surrounded the freshly-extruded filaments to control their temperature and attenuation profiles. These techniques produced yarns with numbers of filaments in the range of 5 to 17, with the latter Patent (the '700 Patent) disclosing nylon yarns. While lower filament count yarns are generally cheaper to make, polyethylene terephthalate yarns of higher filament count are more suitable for commercial fabrics. However, as the filament count of a continuous yarn increases, processability becomes an issue. Moreover, while the '003 Patent in particular is directed to the production of uniform polymeric filaments, there is no disclosure in this Patent or in the other of these Patents ('610, '182 and '700) of denier spread or its effect on uniformity.

Japanese Kokai Patent Application No. Hei 2[1990]-216213 discloses a polyester multi-filament yarn of high uniformity. Although fiber size irregularity is disclosed in this application, there is no disclosure of denier spread in this Application. In addition, no elongation to break is generally disclosed. However, at the spinning speeds and quenching conditions in the Examples given, the resultants yarns would have an elongation to break of less than 100%. Higher values for elongation can be desirable for downstream drawing processes, for example, for draw false twist texturing.

Japanese Kokai Patent Application No. Hei 3[1991]-180508 discloses spinning high strength, low elongation industrial yarns. Again, there is no disclosure of denier spread or of filament count in this Application.

Thus, the prior art fails to disclose a poly(ethylene) terephthalate continuous filament, low denier spread yarn of high elongation with a filament count in a range suitable for economic yet practical processing.

SUMMARY OF THE INVENTION

Therefore, there is provided a continuous filament polyethylene terephthalate yarn of high elongation and low denier spread. In addition, the yarn has a filament count in a range suitable for economic yet practical processing. The filaments of such yarn are partially oriented and therefore are suitable for draw feed yarns, e.g., for draw-texturing.

The yarn of the present invention is made by accelerating a quenching gas and passing the gas with the filaments through a tube, but so that the gas is not accelerated to a speed as high as the speed of the filaments. In this way, the quenching can be improved. Consequently, the uniformity of the resulting filaments can be improved, which is reflected by a low denier spread. For partially oriented yarns, a low denier spread is desirable, as non-uniformities in yarns can trigger problems in their downstream processing.

The present invention is applicable to filaments of low denier per filament (dpf), as their uniformity can be improved according to the invention. Since low denier spread is important to permit high yarn texturing speeds and evenness of coloration and uniformity of bulk or cover in fabrics made of filaments, advantages can be achieved by filaments according to the present invention with a combination of low dpf and low denier spread.

Therefore, in accordance with the present invention, there is provided a continuous filament poly(ethylene terephthalate) yarn of elongation to break (EB) of at least 100%. The yarn comprises filaments numbering in the range of 25 to 150. The yarn is of denier spread given by the expression:

$$\%\ \text{Denier Spread} \leqq 0.11(\text{denier/filament})+0.76$$

This expression is valid for yarns of less than 4.0 denier per filament. Preferably, the yarn has a boil off shrinkage (BOS) of at least 25%.

DETAILED DESCRIPTION OF THE PREFERRED EMBODIMENT

Figure 1:
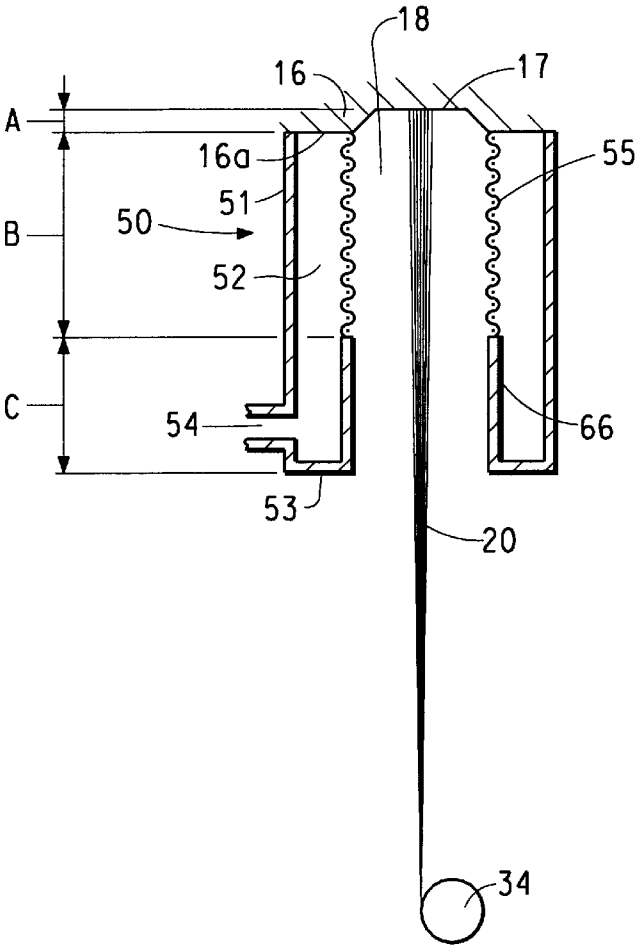
FIG. 1 (PRIOR ART)
FIG. 1 is a schematic elevation view partially in section of an apparatus of the prior art that was used as a control for comparison with the apparatus according to the present invention as shown in FIG. 2.

The quenching system and process used as a control will first be described with reference to FIG. 1 of the drawings.

This quenching system includes a housing 50 which forms a chamber 52 that is supplied with pressurized cooling gas blown in through inlet conduit 54 which is formed in outer wall 51 of housing 50. Chamber 52 has a bottom wall 53 attached to inner wall 66, at the lower portion of chamber 52, below a cylindrical quench screen system 55 that defines the inner surface for the upper portion of chamber 52 and through which the pressurized cooling gas is blown radially inward from chamber 52 into a zone 18 below spinneret face 17 through which zone 18 passes a bundle of filaments 20 which are still molten, having been freshly-extruded from a heated melt in a heated spinning pack 16 through holes (not shown) in spinneret face 17 which is centrally located with respect to housing 50 and is recessed from face 16a (of spinning pack 16) onto which housing 50 abuts. Filaments 20 continue from zone 18 out of the quenching system through a tube formed by inner wall 66 that surrounds the filaments, down to puller roll 34, the surface speed of which is termed the withdrawal speed of the filaments 20.

The following dimensions are shown in FIG. 1, as they are shown for the conventional radial quench controls, e.g., in Tables 1–7:

A—Quench Delay Height, being the height of spinneret face 17 above face 16*a;*

B—Quench Screen Height, being the height of cylindrical quench screen system 55 (extending from face 16*a* to the top of inner wall 66); and C—Tube Height, being the height of inner wall 66 surrounding filaments 20 after they pass below the bottom of cylindrical quench screen system 55 until they pass below the bottom 53 of housing 50.

As will be understood, the total height for the process we used as a control from the spinneret (face) to the tube exit was A+B+C.

A preferred quenching system and process according to the present invention will now be described with reference to FIG. 2 of the drawings, similar reference numerals indicating like elements as in FIG. 1, such as for the heated spinning pack 16, face of spinning pack 16a to which housing 50 is attached, spinneret face 17, zone 18, filaments 20, puller roll 34, outer wall 51 of housing 50, chamber 52, bottom wall 53, inlet 54 and cylindrical quench screen system 55. Proceeding down below cylindrical quench screen system 55, however, the quenching system and process are different from the control shown in FIG. 1 and described above. Proceeding down, the filaments may pass effectively through a short tube 71 of the same internal diameter as cylindrical quench screen system 55, and pass preferably through a tapered section 72, before entering a tube 73 of smaller internal diameter, the dimensions of the elements being such that filaments 20 are undergoing attenuation as they enter tube 73, and, taking into account the amount of cooling gas blown into inlet 54 and out of tube 73 with filaments 20, the speed of such gas leaving tube 73 is less than the speed of filaments 20 as they leave tube 73. Filaments 20 will preferably have already hardened before they leave tube 73, in which case, when they leave tube 73, their speed will already be the same speed as their withdrawal speed at roll 34.

Figure 2:
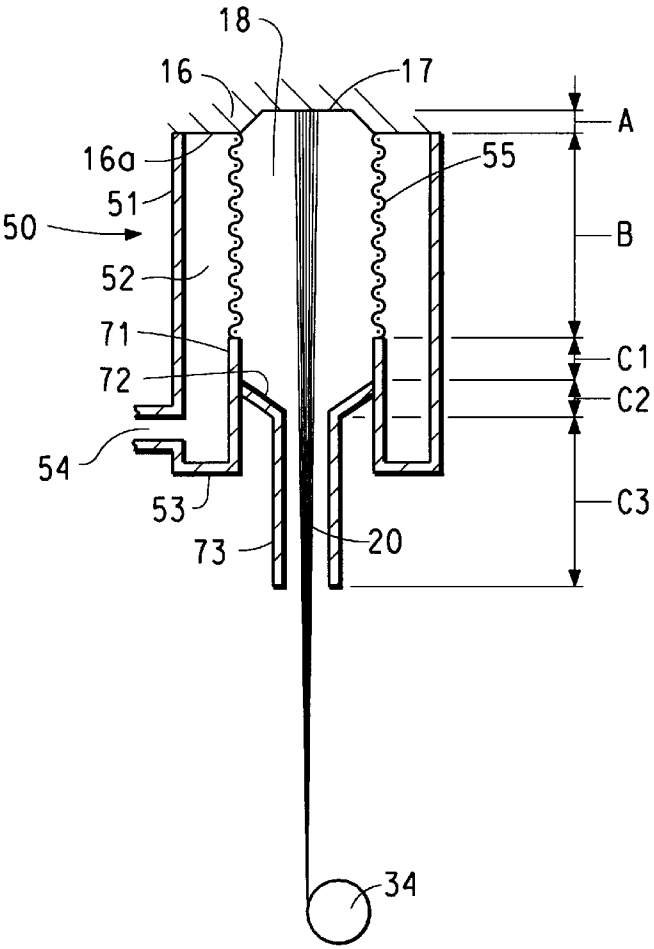
FIG. 2 is a schematic elevation view, partially in section, of one embodiment of an apparatus for practicing the invention, as used in Example 7, and for indicating heights used for various elements of the quenching system used in Examples 1–6.

In addition to the height dimensions A and B discussed above as being shown in FIG. 1, Tables 1–7 also lists for FIG. 2:

$C_1$—Connecting Tube Height, being the height of any short tube 71;

$C_2$—Connecting Taper Height, being the height of any tapered section 72;

$C_3$—Tube Height, being in this instance, the height of tube 73 of restricted internal diameter that causes the cooling gas to accelerate out of zone 18.

As will be understood, the total height for the process used to make yarns of this invention from the spinneret (face) to the tube exit is $A+B+C_1+C_2+C_3$.

As shown in both FIGS. 1 and 2, filaments 20, after leaving the quench systems, continue down to driven roll 34 which pulls filaments 20 in their path from the heated spinneret so their speed at roll 34 is the same as the surface speed of driven roll 34 (disregarding slippage), this speed being known as the withdrawal speed. As is conventional (but not shown in the drawings) a finish is applied to the solid filaments 20 before they reach driven roll 34 as a yarn. At that point, different types of windup may be used, a three roll windup system being preferred for continuous filament yarns, as shown by Knox in U.S. Pat. No. 4,156,071, with interlacing as shown therein, or, for example, a so-called godet-less system, wherein yarn is interlaced and then wound as a package on the first driven roll shown as 34 in FIG. 1, or, for example, filaments are not interlaced nor wound but may be passed as a bundle of parallel continuous filaments for processing as tow, several such bundles generally being combined together for tow-processing.

Figure 3:
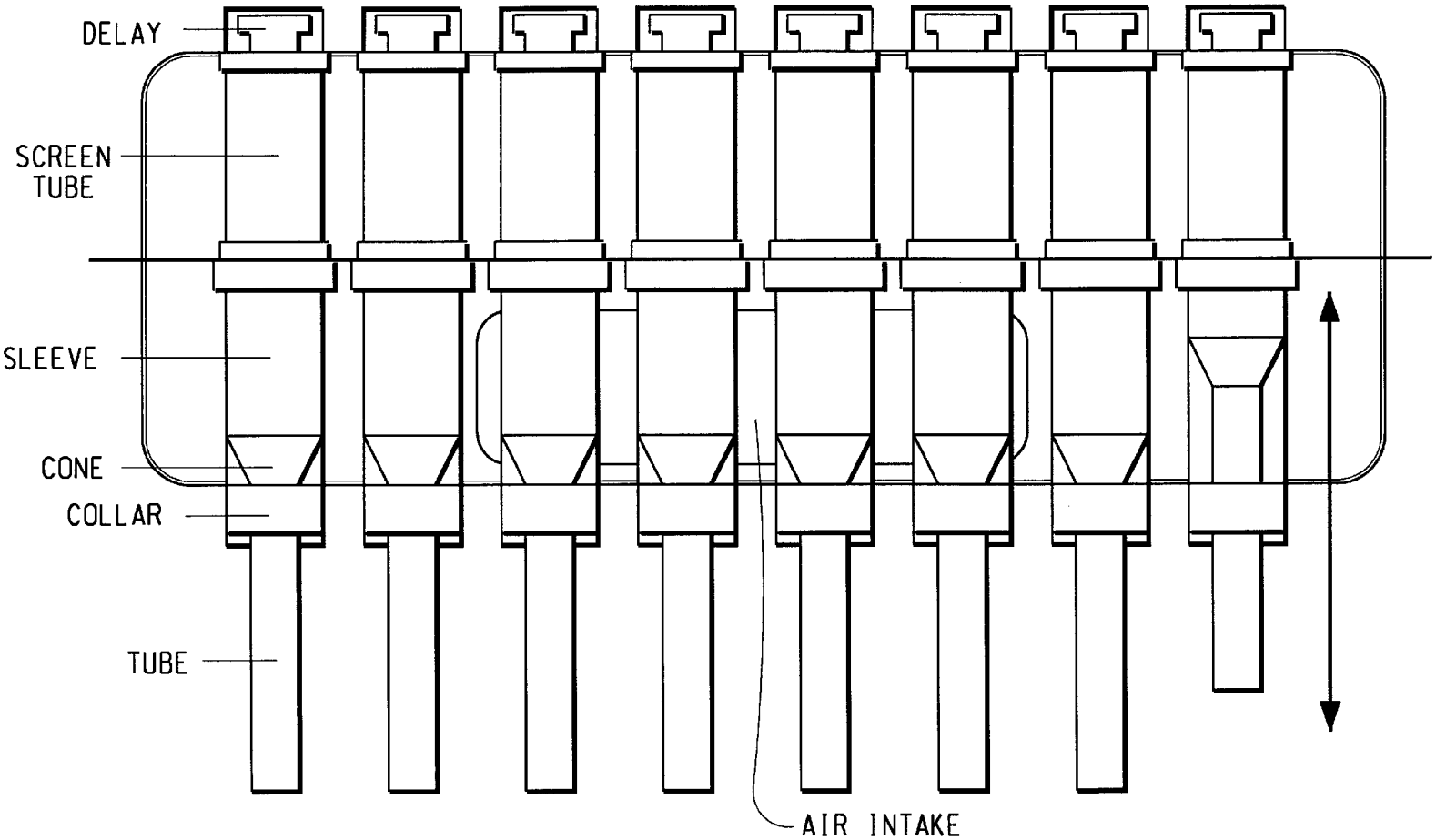
FIG. 3 is a schematic elevation view, partially in section, of another embodiment of an apparatus for practicing the invention, and as used in Examples 1–6.

Referring to FIG. 3, a schematic arrangement of eight quenching systems according to the invention is shown, by way of example, within a single diffuser. The various elements are shown on the system at the left, in order, referring to FIG. 2 (and the Tables in the Examples hereinafter), "Delay" corresponding to "Quench Delay Height A" between spinneret face 17 and face 16*a*, "Screen Tube" corresponding to "Quench Screen Height B" extending down to the bottom of cylindrical quench screen system 55 and top of short tube 71, "Sleeve" corresponding to "Connecting Tube Height ($C_1$)" extending down to top of tapered section 72, "Cone" corresponding to "Connecting 60° Taper Height ($C_2$)" extending down to top of tube 73 of smaller internal diameter, and "Tube" corresponding to "Tube Height ($C_3$)", i.e., the tube 73 of smaller internal diameter itself. It will be noted that the latter "Tube" is shown as adjustable, being raised for the system on the right, which provides means for controlling the location of such tubes. Also a tube of different dimensions may be substituted and/or the supply of cooling gas (blown through a common "Air Intake") may be adjusted in volume and/or temperature to adjust the quenching conditions and ensure that the gas speed is accelerated, but accelerated only to less than the speed of the filaments.

The system and process of the present invention may be operated with an accelerated gas speed of about one quarter to about one half that of the withdrawal speed of the filaments. The gas speed through the tube is easy to calculate from the volume of gas supplied and the cross-section of the tube, and the withdrawal speed of the filaments is easier to measure than the speed of the filaments as they leave the tube. It is preferred that the filaments have hardened before they leave the tube, so that the filaments are preferably already at or near the withdrawal speed as they leave the tube with the gas at a slower speed than the filaments. The relative speeds of the gas and filaments may be varied according to the results desired, e.g., as little as about 20% to about 60% of the filament speed, or even up to 90% or as much as 95%, if desired, but we have found it important to avoid acceleration of the gas speed to more than the speed of the filaments as both emerge from the bottom of the quenching system, in contrast to suggestions previously in the art.

Thus, according to the invention, the cooling gas is first introduced into the zone below the spinneret where the freshly-extruded filaments emerge as separate streams in molten form from the spinneret through the capillaries. This introduction of the cooling gas may be performed in various ways. For instance, conventional methods of introducing the cooling gas may be used, or new ways may be devised. Whatever method is chosen, the cooling gas is likely to be introduced into the zone with a relatively small component of velocity in the direction of motion of the filaments which are themselves moving slowly away from the spinneret. The cross-sectional area of such zones has conventionally been considerably larger than the cross-sectional area of the array of freshly-extruded filaments. To leave the zone, however, the cooling gas must, according to the invention, enter a tube of restricted cross-sectional area (less than the cross-sectional area of the zone), so the gas must accelerate as it enters and passes down the tube. It is believed that this forces the cooling gas into the filamentary array, which enhances the cooling effect of this gas on the filaments.

Providing a tapered entrance to the tube is preferred. It is believed that an appropriately-tapered entrance to the tube smoothes the acceleration of the cooling gas, and avoids turbulence such as could lead to less uniformity along-end. Tapered entrances to tubes have been used, with taper angles of 30°, 45° and 60°, the optimum taper angle depending on a combination of factors. A tube of 1 inch (2.5 cm) diameter has been found very useful in practice. A tube of 1.25 inches (3.2 cm) diameter has also been used effectively. It is preferable that the top of the tube is not spaced too far from the spinneret. The top of the tube should be spaced 80 cm or less from the face of the spinneret, and preferably less than 64 cm.

The shape of the tube that is of restricted dimensions need not only be of cylindrical cross-section, but may vary, especially when a non-circular array of filaments is extruded. Thus, for instance, tubes of rectangular, square, oval or other cross-section may be used. The dimensions of the cross-section of such tubes are of importance in calculating the speed of the cooling gas emerging therefrom, in conjunction with the volume of cooling gas that is supplied.

The cooling gas is preferably air, especially for polyester processing, because air is cheaper than other gas, but other gas may be used, for instance steam, or an inert gas.

With this process, it is possible to improve uniformity and/or increase the withdrawal speed of the yarn without a corresponding reduction in the elongation (EB) or an increase in the draw tension. Denier spread (DS) is used herein to show improved uniformity. Denier spread is a measure of the along-end unevenness of a yarn by calculating the variation in mass measured at regular intervals along the yarn. Elongation to break is a measure of the extent to which one can draw yarn before it breaks, and is measured as a percentage of the original length, as described in U.S. Pat. No. 5,066,447.

Thus, according to the present invention, a continuous filament poly(ethylene terephthalate) yarn of elongation to break of about 100% or more is produced. This yarn comprises filaments numbering in the range of 25 to 150. The yarn is of denier spread given by the expression:

$$\%\ \text{Denier Spread} \leqq 0.11(\text{denier/filament})+0.76$$

This expression is valid for yarns of less than 4.0 denier per filament (less than 4.5 dtex per filament).

Figure 4:
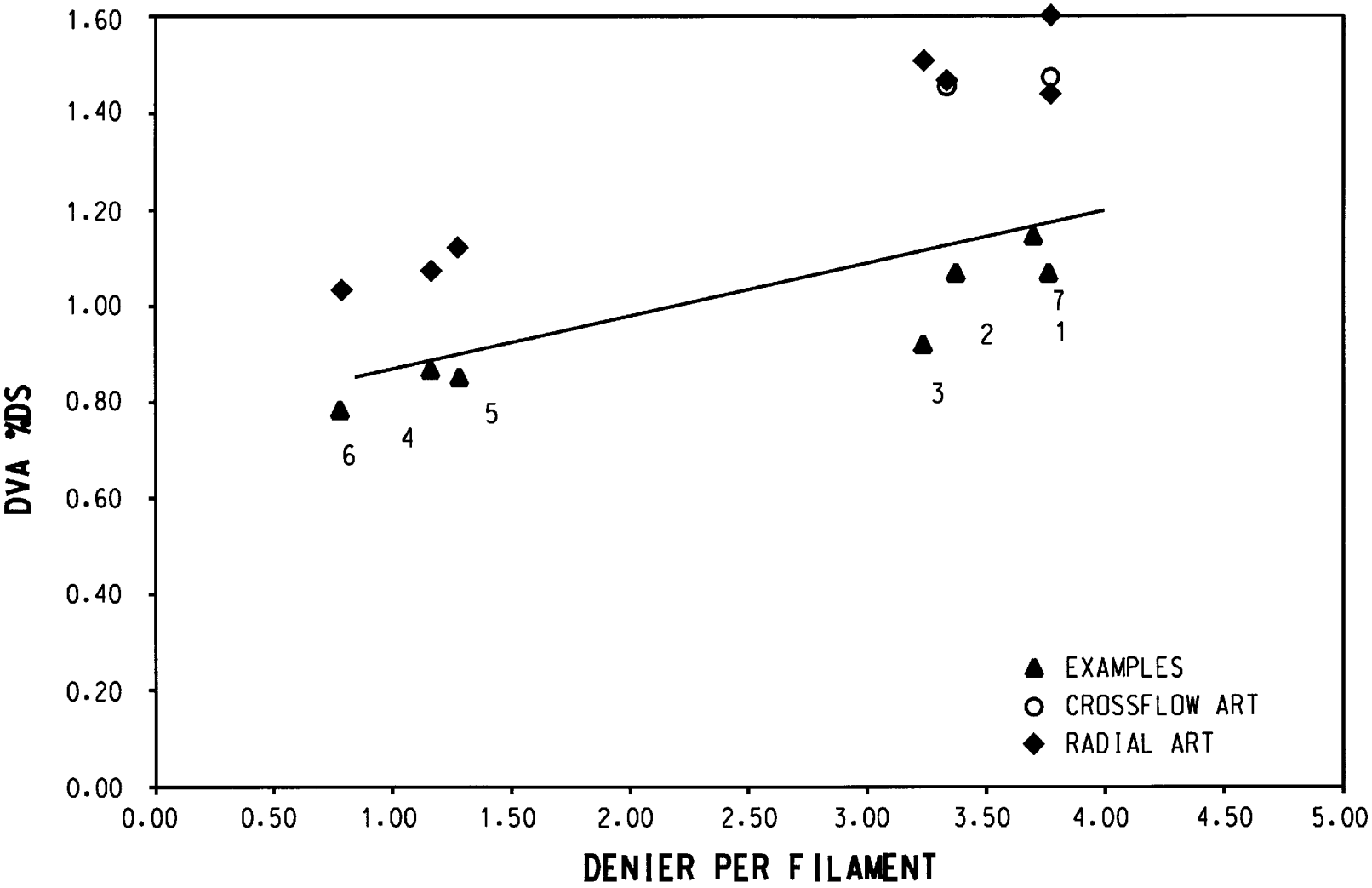
FIG. 4 is a plot of denier spread (DS) vs. denier per filament (dpf) for products of the invention and, for comparison, of prior commercial products and of yarns from examples in the published art, as will be explained hereinafter.

FIG. 4 illustrates Denier Spreads vs. denier per filament for yarns of the present invention according to the Examples below, as well as prior art yarns of similar denier and number of filaments.

Preferably, the yarns of the present invention have a boil off shrinkage (BOS) of at least 25%. Boil off shrinkage quantifies the type of yarn and is measured conventionally, as described in the art.

The invention is further illustrated in the following Examples. Most of the fiber properties of concern in the Examples are conventional tensile and shrinkage properties, measured conventionally, and/or as described in the art cited. Relative viscosity is often referred to herein as "LRV", and is the ratio of the viscosity of a solution of 80 mg of polymer in 10 ml of a solvent to the viscosity of the solvent itself, the solvent used herein for measuring LRV being hexafluoroisopropanol containing 100 ppm of sulfuric acid, and the measurements being made at 25° C., as described in Broaddus U.S. Pat. No. 5,104,725 and in Duncan U.S. SIR H1275.

Denier spread (DS) herein is defined and measured as follows, by running yarn through a capacitor slot which responds to the instantaneous mass in the slot. The test sample is electronically divided into eight 30 m subsections with measurements every 0.5 m. Differences between the maximum and minimum mass measurements within each of the eight subsections are averaged. The Denier Spread (DS) herein is recorded as a percentage of this average difference divided by the average mass along the whole 240 m of the yarn. Testing can be conducted on an ACW400/DVA (Automatic Cut and Weigh/Denier Variation Accessory) instrument available from Lenzing Technik, Lenzing, Austria, A-4860.

The Draw Tension, in grams, was measured at a draw ratio of 1.7×, and at a heater temperature of 180° C. Draw tension is used as a measure of orientation, and is a very important requirement especially for texturing feed yarns. Draw tension may be measured on a DTI 400 Draw Tension Instrument, also available from Lenzing Technik. Normally, an increase in the withdrawal speed is accompanied by an increase in the draw tension and a reduction in the elongation, which can be undesirable, whereas the present invention has achieved increases in the withdrawal speed without increasing the draw tension or reducing the elongation, as will be seen in the Examples hereinafter.

These Examples provide comparison with control experiments that were run similarly but not according to the invention. It is believed that the air speed was always significantly less than the speed of the filaments as they both left the tube in each of the following Examples according to the invention, although the air speeds were always significantly increased over the air speeds in the corresponding control experiments, as can be seen in each Table.

EXAMPLE 1

A 127 denier—34 filament, round cross-section, polyester yarn (see Table 1) was spun at 297° C. from poly(ethylene terephthalate) polymer of 21.5 LRV using a quenching system as described hereinbefore and illustrated with reference to FIG. 2, the pertinent processing parameters being shown in Table 1, to give yarn whose parameters are also given in Table 1. The internal diameter of the quench screen 55 was 3 inches (7.5 cm), below which was a tapered section 72 of height $C_2$, referred to as "Connecting 30° Taper Height" in Table 1, and connecting to a tube 73 of restricted internal diameter 1 inch (2.5 cm) and of height $C_3$. The "30° Taper" referred to is the 30° angle included in the tapered section, i.e., the tapered surface is inclined at an angle of 15° from the vertical. This configuration locates the entrance of tube 73 13.6 inches (34.5 cm) from spinneret face 17.

For comparison, a control yarn 'A' was also spun from similar polymer at 295° C. using a quenching system as described hereinbefore and illustrated with reference to FIG. 1, the pertinent processing and resulting yarn parameters being also shown for comparison in Table 1. For this control yarn 'A', the internal diameters of the quench screen 55 was 3 inches (7.6 cm), followed by exhaust outlet 66 of 2.75 inch (7.0 cm) diameter, so the air speed emerging from the tube was much lower than for the air emerging according to the invention. 34.9 cfm (16.5 liters/sec) of quench air were used in Example 1 versus 43.5 cfm (20.5 liters/sec) for the control 'A'. The air was initially at room temperature.

A second control yarn 'B' was spun using polymer and spinning temperatures of 289° C. with a crossflow quench system supplying 1278 cfm (603 liters/sec) per 6 threadlines through a diffusing screen of 47.2 inch (119.9 cm) length and 32.7 inch (83.1 cm) width, and cross-sectional area of 1543 in $^2$ (9955 cm$^2$).

TABLE 1

| PROCESSING PARA-METERS | CONTROL 'A' | CONTROL 'B' | EXAMPLE 1 |
|---|---|---|---|
| Quench Dimensions, inches (cm) | | | |
| Crossflow Quench Screen Width | | 32.7 (83.1) | |
| Crossflow Quench Screen Height | | 47.2 (119.9) | |
| Quench Delay Height A | 3.9 (9.9) | 3.7 (9.5) | 3.9 (9.9) |
| Quench Screen Height B | 6.0 (15.2) | | 6.0 (15.2) |
| Connecting Tube Height ($C_1$) | 0 | | 0 |
| Connecting 30° Taper Height ($C_2$) | | | 3.7 (9.4) |
| Tube Heights (C and $C_3$) | 7.5 (19.0) | | 12.0 (30.5) |
| Spinneret to tube entrance ($A + B + C_1 + C_2$) | | | 13.6 (34.5) |
| Total Height (Spinneret-Tube exit) | 17.4 (44.2) | | 25.6 (65.0) |
| Speeds | | | |
| Tube Exit Air Speed, mpm | 321 | | 1952 |
| Withdrawal Speed, mpm | 3265 | 3025 | 3886 |
| Yarn Parameters (3.75 dpf, 4.2 dtex/fil) | | | |
| Number Orifices/ Filaments | 34 | 34 | 34 |
| Denier (dtex) | 127.4 (141.4) | 127.3 (141.4) | 127.8 (141.9) |
| Denier Spread, % | 1.60 | 1.45 | 1.09 |
| Draw Tension, grams | 62.5 | 62.3 | 63.0 |
| Tenacity, gpd (g/dtex) | 2.5 (2.3) | 2.4 (2.2) | 2.4 (2.2) |
| Elongation at Break, % | 135 | 131 | 128 |

It will be noted that the yarn of Example 1 had a surprisingly and significantly better (lower) Denier Spread than did either of the conventional radial or crossflow quench control yarns 'A' or 'B', 1.09% versus 1.60% and 1.45% (32% and 25% lower than Control 'A' and Control 'B' respectively). This is a significantly improved yarn product, where the Denier Spreads are shown to have values according to the equation mentioned above and derived from the information of FIG. 4.

With the present invention, other properties (ie. draw tension, tenacity, elongation at break) of example yarns that are comparable to both control yarns have been achieved. The improvement in Denier Spread was obtained despite the yarn of Example 1 having been spun at a withdrawal speed that was more than 19% and 28% faster than Control 'A' and Control 'B' (3886 vs. 3265 and 3025 mpm) respectively. If, however, other control yarns are spun using either of the conventional radial or crossflow control quenching systems at the withdrawal speed (3886 mpm) used for Example 1, the draw tension of the other control yarns would increase to over 100 grams, thus limiting the drawability of the yarn.

By using a tube of restricted diameter (only 1 inch diameter) in Example 1 according to the invention, the speed of the cooling air was increased about 6× from 321 mpm (in control 'A') to 1952 mpm according to the invention. But this higher air speed was only about 50% of the withdrawal speed of the filaments.

EXAMPLE 2

A similar 115-34, round cross-section, light denier polyester yarn was spun using the same quench system as in Example 1, the parameters being shown in Table 2. Control yarn comparisons for conventional radial and a modified crossflow quench system using a tubular delay assembly as described in U.S. Pat. 4,529,368 (Makansi) were also spun, the parameters also shown in Table 2.

34.9 cfm (16.5 liters/sec) of quench air were used in Example 2 versus 41.1 cfm (19.4 liters/sec) for Control 'A' and 52.5 cfm (24.8 liters/sec) per threadline for Control 'B'. The crossflow quench system for Control 'B' is made from 8 partitioned cells having diffusing screen dimensions of 2.75 inch (7.0 cm) width and 30 inch (76.2 cm) length.

TABLE 2

| PROCESSING PARA-METERS | CONTROL 'A' | CONTROL 'B' | EXAMPLE 2 |
|---|---|---|---|
| Quench Dimensions, inches (cm) | | | |
| Crossflow Quench Screen Width | | 2.75 (7.0) | |
| Crossflow Quench Screen Height | | 30.0 (76.2) | |
| Quench Delay Height A | 3.9 (9.9) | 3.1 (7.9) | 3.9 (9.9) |
| Quench Screen Height B | 6.0 (15.2) | | 6.0 (15.2) |
| Connecting Tube Height ($C_1$) | 0 | | 0 |
| Connecting 30° Taper Height ($C_2$) | | | 3.7 (9.4) |
| Tube Heights (C and $C_3$) | 7.5 (19.0) | | 12.0 (30.5) |
| Spinneret to tube entrance ($A + B + C_1 + C_2$) | | | 13.6 (34.5) |
| Total Height (Spinneret-Tube exit) | 17.4 (44.2) | | 25.6 (65.0) |
| Speeds | | | |
| Tube Exit Air Speed, mpm | 303 | | 1952 |
| Withdrawal Speed, mpm | 3155 | 3110 | 3730 |
| Yarn Parameters (3.4 dpf, 3.8 dtex/fil) | | | |
| Number Orifices/ Filaments | 34 | 34 | 34 |
| Denier (dtex) | 115.5 (128.2) | 115.3 (128.1) | 115. (128.2) |
| Denier Spread, % | 1.44 | 1.43 | 1.05 |
| Draw Tension, grams | 55.0 | 54.6 | 55.8 |

TABLE 2-continued

| PROCESSING PARA-METERS | CONTROL 'A' | CONTROL 'B' | EXAMPLE 2 |
|---|---|---|---|
| Tenacity, gpd (g/dtex) | 2.4 (2.2) | 2.5 (2.3) | 2.4 (2.2) |
| Elongation at Break, % | 131 | 128 | 126 |

Again, in Example 2, a significant improvement was obtained in along-end denier uniformity, a lower Denier Spread of 1.05% vs. 1.44% and 1.43% (27% lower than Control 'A' and Control 'B' respectively), with the Example Denier Spread value being lower than the value given by the Denier Spread versus dpf expression of FIG. 4. Example 2 was spun with comparable draw tension, tenacity, elongation at break, and at a significantly higher withdrawal speed, 3730 mpm being more than 18–20% higher than the controls. Again, the speed of the cooling air was increased approximately 6× to 1952 mpm in Example 2 (versus Control 'A' tube air speed of 303 mpm) by passing the cooling air through a tube of restricted diameter, one third of the diameter of the quench screen. The resulting air speed still being approximately 52% of the withdrawal speed.

EXAMPLE 3

A 110-34, trilobal cross section, light denier polyester yarn (see Table 3) was spun using a quenching system as described hereinbefore and illustrated with reference to FIG. 2, the parameters being shown in Table 3 for this Example 3, as well as a radial quench control yarn. In Example 3, the filaments were spun from polymer at 297° C., whereas the control yarn was spun from polymer at 296° C.

The example yarn was quenched using 32.0 cfm (15.1 liters/sec), whereas the control yarn used 30.0 cfm (14.2 liters/sec). In both cases, the quench air was at approximately room temperature (70° F., 21° C.)

TABLE 3

| PROCESSING PARAMETERS | CONTROL | EXAMPLE 3 |
|---|---|---|
| Quench Dimensions, inches (cm) | | |
| Quench Delay Height A | 3.9 (9.9) | 3.9 (9.9) |
| Quench Screen Height B | 6.0 (15.2) | 6.0 (15.2) |
| Connecting Tube Height ($C_1$) | 0 | 0 |
| Connecting 30° Taper Height ($C_2$) | | 3.7 (9.4) |
| Tube Heights (C and $C_3$) | 7.5 (19.0) | 12.0 (30.5) |
| Spinneret to tube entrance ($A + B + C_1 + C_2$) | | 13.6 (32.0) |
| Total Height (Spinneret-Tube exit) | 17.4 (44.2) | 25.6 (65.0) |
| Speeds | | |
| Tube Exit Air Speed, mpm | 223 | 1787 |
| Withdrawal Speed, mpm | 3342 | 3731 |
| Yarn Parameters (3.24 dpf, 3.60 dtex/fil) | | |
| Number Orifices/Filaments | 34 | 34 |
| Denier (dtex) | 110.0 (122.2) | 110.0 (122.2) |
| Denier Spread, % | 1.49 | 0.91 |
| Draw Tension, grams | 75.0 | 75.7 |
| Tenacity, gpd (g/dtex) | 2.6 (2.3) | 2.4 (2.2) |
| Elongation at Break, % | 121 | 122 |

In Example 3, a significant improvement was obtained in along-end denier uniformity, a 39% lower Denier Spread of 0.91% vs. 1.49 for the control yarn. The Denier Spread of this example is lower than the value calculated using the expression in FIG. 4. Example 3 was spun with draw tension, tenacity, and elongation at break comparable to the control, and at 11.6% higher withdrawal speed (3731 mpm vs. 3342 mpm). The cooling air speed was increased to 8× greater than the control by passing the air and filaments through the tube of restricted diameter, the example air speed being 48% of the withdrawal speed.

EXAMPLE 4

A fine dpf, 115-100, round polyester yarn was spun using a quenching system similar to previous examples and, for comparison, a control as shown in Table 4.

Example 4 used 23.5 cfm (11.1 liters/sec) of quenching air, and the control used 27.2 cfm (12.8 liters/sec). The air was initially at room temperature (70° F., 21° C).

TABLE 4

| PROCESSING PARAMETERS | CONTROL | EXAMPLE 4 |
|---|---|---|
| Quench Dimensions, inches (cm) | | |
| Quench Delay Height A | 3.9 (9.9) | 3.9 (9.9) |
| Quench Screen Height B | 6.0 (15.2) | 5.0 (12.7) |
| Connecting Tube Height ($C_1$) | 0 | 0 |
| Connecting 30° Taper Height ($C_2$) | | 3.7 (9.4) |
| Tube Heights (C and $C_3$) | 7.5 (19.0) | 12.0 (30.5) |
| Spinneret to tube entrance ($A + B + C_1 + C_2$) | | 12.6 (32.0) |
| Total Height (Spinneret-Tube exit) | 17.4 (44.2) | 24.6 (62.5) |
| Speeds | | |
| Tube Exit Air Speed, mpm | 201 | 1316 |
| Withdrawal Speed, mpm | 2743 | 3283 |
| Yarn Parameters (1.15 dpf, 1.28 dtex/fil) | | |
| Number Orifices/Filaments | 100 | 100 |
| Denier (dtex) | 115.6 (128.4) | 117.3 (129.0) |
| Denier Spread, % | 1.08 | 0.87 |
| Draw Tension, grams | 69.0 | 70.1 |
| Tenacity, gpd (g/dtex) | 2.8 (2.5) | 2.8 (2.6) |
| Elongation at Break, % | 131 | 131 |

Example 4 shows a significant improvement in along-end denier uniformity, a lower Denier Spread of 0.87% vs. 1.08% (Example 4 is 19% lower than the control). This example's Denier Spread value is lower than that given by the expression in FIG. 4. Draw tension, tenacity, and elongation at break for Example 4 were comparable to the control; however, Example 4 was spun with a 20% higher withdrawal speed (3283 mpm versus 2743 mpm). The cooling air speed in the example was more than 6× that of the control (1316 mpm versus 201 mpm), but was still 40% of the example withdrawal speed (1316 mpm versus 3283 mpm).

EXAMPLE 5

A 170 denier (189 dtex), 136 filaments polyester yarn was spun using a quenching system as described herein before and illustrated with reference to FIG. 2. The parameters are shown in Table 5 for this Example 5; and, for comparison, a control yarn was spun using a radial quench illustrated with reference to FIG. 1. In Example 5, the filaments were spun from a polymer of nominal 21.5 LRV and at 298° C., whereas the control yarn was spun from similar polymer at 296.5° C.

Despite the higher polymer temperature, we used less quench air (at 70° F., i.e. 21° C.), only 19.1 CFM per yarn (9.0 liters/sec) in Example 5, i.e. only 73% as much as the 26.2 CFM per yarn (12.4 liters/sec.) used for this control yarn.

TABLE 5

| PROCESSING PARAMETERS | CONTROL | EXAMPLE 5 |
|---|---|---|
| Quench Dimensions, inches (cm) | | |
| Quench Delay Height A | 2.6 (6.6) | 2.6 (6.6) |
| Quench Screen Height B | 6.0 (15.2) | 4.0 (10.2) |
| Connecting Tube Height ($C_1$) | 0 | 0 |
| Connecting 30° Taper Height ($C_2$) | | 3.7 (9.4) |
| Tube Heights (C or $C_3$) | 7.5 (19.0) | 12.0 (30.5) |
| Spinneret to tube entrance ($A + B + C_1 + C_2$) | | 10.3 (26.2) |
| Total Height (Spinneret-to-Tube exit) | 16.1 (40.9) | 22.3 (56.6) |
| Speeds | | |
| Tube Exit Air Speed, mpm | 194 | 1065 |
| Withdrawal Speed, mpm | 2542 | 2990 |
| Yarn Parameters | | |
| Number Orifices (Filaments) | 136 | 136 |
| Denier (dtex) | 170.8 (189.6) | 170.2 (189.0) |
| Denier Spread, % | 1.12 | 0.85 |
| Draw Tension, grams | 70.0 | 101.5 |
| Tenacity, gpd (g/dtex) | 2.7 (2.4) | 2.7 (2.4) |
| Elongation at Break, % | 152 | 145 |

In Example 5 the Quench Delay Height A was reduced to 2.6 in. (6.6 cm), compared to 3.9 in. (9.9 cm) used in previous examples.

In Example 5, a significant improvement was obtained in uniformity, a lower Denier Spread of 0.85% vs. 1.12%, while retaining 145% elongation to break in the yarn so that the 170 denier, 136 filament yarn could be drawn to a nominal 100 denier, i.e. to filaments having fineness of less than 1 denier per filament (i.e. to "subdenier"). The improvement in uniformity of this fine denier-per-filament yarn was achieved while spinning at a significantly higher withdrawal speed, 2990 ypm being some 17.6% higher than 2542 ypm. The air speed was increased 5× to 6× that of the standard radial process by passing the air and filaments through the tube of restricted diameter, but the air speed was still only about 36% of the withdrawal speed of the filaments. The Denier Spread of Example 5 yarn was lower than that given by the expression in FIG. 4, and is shown on FIG. 4 along with the Denier Spread of the 170 denier, 136 filament control yarn spun using the previous radial quench configuration. This improvement in uniformity was obtained with only about 73% the volume of cooling air.

EXAMPLE 6

A 115 denier (128 dtex), 136 filament polyester yarn (see Table 6), i.e. a yarn made up of subdenier filaments, was spun using a quenching system as described herein before and illustrated with reference to FIG. 2, the parameters being shown in Table 6 for this Example 6. For comparison, a 115 denier, 136 filament control yarn was spun using a previous radial quench configuration as illustrated with reference to FIG. 1. In Example 6, the filaments were spun from a polymer having nominal LRV of 21.5, and using a polymer temperature of 304° C., whereas the control yarn was spun from similar LRV polymer at 295.5° C.

TABLE 6

| PROCESSING PARAMETERS | CONTROL | EXAMPLE 6 |
|---|---|---|
| Quench Dimensions, inches (cm) | | |
| Quench Delay Height A | 2.6 (6.6) | 2.6 (6.6) |
| Quench Screen Height B | 6.0 (15.2) | 4.0 (10.2) |
| Connecting Tube Height ($C_1$) | 0 | N/A |
| Connecting 30° Taper Height ($C_2$) | | 3.7 (9.4) |
| Tube Heights (C or $C_3$) | 7.5 (19.0) | 12.0 (30.5) |
| Spinneret to tube entrance ($A + B + C_1 + C_2$) | | 10.3 (26.2) |
| Total Height (Spinneret-to-Tube exit) | 16.1 (40.9) | 22.3 (56.6) |
| Speeds | | |
| Tube Exit Air Speed, mpm | 194 | 1065 |
| Withdrawal Speed, mpm | 2606 | 2903 |
| Yarn Parameters | | |
| Number Orifices (Filaments) | 136 | 136 |
| Denier (dtex) | 115.8 (128.6) | 116.1 (128.9) |
| Denier Spread, % | 1.02 | 0.79 |
| Draw Tension, grams | 75.0 | 74.0 |
| Tenacity, gpd (g/dtex) | 2.8 (2.5) | 2.8 (2.5) |
| Elongation at Break, % | 130 | 135 |

Although the yarn of Example 6 was produced at over 11% increased withdrawal speed and throughput, and also at increased spinning temperature, less quenching air volume (at 70° F., 21° C.) was used in Example 6, i.e. 19.1 CFM (9.0 liters/sec.) per yarn, as compared with 26.2 CFM (12.4 liters/sec.) per yarn for the control. The subdenier yarn of Example 6 had surprisingly good uniformity for such a fine denier-per-filament yarn, having a Denier Spread of only 0.79%, compared with 1.02% Denier Spread in the Control yarn. The Denier Spread of Example 6 yarn is lower than that given by the expression in FIG. 4, and is shown on FIG. 4 along with the Denier Spread of the 115 denier, 136 filaments control yarn which used the previous radial quench configuration. The 23% improvement in uniformity of this subdenier yarn was achieved while increasing the production rate, and using only 73% the volume of cooling air.

EXAMPLE 7

A 125-34 light denier polyester yarn (see Table 7) was spun at 292° C. from poly(ethylene terephthalate) polymer of 21.9 LRV using a quenching system as described hereinbefore and illustrated with reference to FIG. 2, the pertinent processing parameters being shown in Table 7, to give yarn whose parameters are also given in Table 7. The internal diameter of the quench screen 55 was 3 inches (7.5 cm), below which was a connecting tube 71, of the same internal diameter and of height $C_1$, below which was a tapered section 72 of height $C_2$, referred to as "Connecting 60° Taper Height" in Table 7, and connecting to a tube 73 of restricted internal diameter 1 inch (2.5 cm) and of height $C_3$. The "60° Taper" referred to is the 60° angle included in the tapered section, i.e., the tapered surface is inclined at an angle of 30° from the vertical.

For comparison, a control yarn was also spun from similar polymer at 292° C. using a quenching system as described hereinbefore and illustrated with reference to FIG. 1, the pertinent processing and resulting yarn parameters being also shown for comparison in Table 7. For this control yarn, the internal diameters of the quench screen 55 and of the tube 66 below the screen were both 3 inches (7.5 cm), i.e., there was no use of a tube of restricted diameter below the quench screen, so the air speed emerging from the tube was much lower than for the air emerging in this Example.

The same amounts of quench air (30 CFM, 14 liters/sec.) were used in Example 7 and for the control. The air was initially at room temperature.

TABLE 7

| PROCESSING PARAMETERS | CONTROL | EXAMPLE 7 |
|---|---|---|
| Quench Dimensions, inches (cm) | | |
| Quench Delay Height A | 1 (2.5) | 1 (2.5) |
| Quench Screen Height B | 8 (20) | 8 (20) |
| Connecting Tube Height ($C_1$) | | 3 (7.5) |
| Connecting 60° Taper Height ($C_2$) | | 2 (5) |
| Tube Heights (C and $C_3$) | 8 (20) | 18 (46) |
| Total Heights (Spinneret-Tube exit) | 17 (43) | 32 (84) |
| Speeds | | |
| Tube Exit Air Speed, mpm | 187 | 1680 |
| Withdrawal Speed, mpm | 3290 | 4015 |
| Yarn Parameters (3.7 dpf, 4.1 dtex) | | |
| Number Orifices/Filaments | 34 | 34 |
| Denier (dtex) | 127 (141) | 126 (140) |
| Denier Spread, % | 1.43 | 1.15 |
| Draw Tension, grams | 60 | 59 |
| Tenacity, gpd (g/dtex) | 2.6 (2.3) | 2.4 (2.2) |
| $E_B$, % | 127 | 123 |
| BOS, % | 61 | 66 |

It will be noted that the yarn of Example 7 had a surprisingly and significantly better (lower) Denier Spread than did the control, 1.15% vs. 1.43% (which is more than 20% higher than 1.15%). This is a significant advantage derived from use of the invention. We have achieved other properties of both yarns that were comparable. The improvement in Denier Spread was obtained despite the yarn of Example 7 having been spun at a withdrawal speed that was more than 20% faster (4015 vs. 3290 mpm). When, however, another control yarn was spun using the same control quenching system at the withdrawal speed (4015 mpm) used for Example 7, the draw tension of this other control yarn increased to over 150 grams.

By using the same amount of quench air with a tube of restricted diameter (only 1 inch diameter) in Example 7 according to the invention, the speed of the cooling air was accelerated about 9× from less than 20° mpm (in the control) to almost 1700 mpm according to the invention. But this higher air speed was only about 40% of the withdrawal speed of the filaments.

What is claimed is:

1. A poly(ethylene terephthalate) yarn comprising continuous filaments wherein the filaments number in the range of about 25 to about 150, and the yarn is of elongation to break of about 100% or more, of denier per filament of less than 4, and the yarn is of denier spread given by the expression:

$$\% \text{ Denier Spread} \leqq 0.11(\text{denier/filament})+0.76.$$

2. A poly(ethylene terephthalate) yarn comprising continuous filaments wherein the filaments number in the range of about 25 to about 150, and the yarn is of elongation to break of about 100% or more, of denier per filament of less than 4, and the yarn is of denier spread given by the expression:

$$\% \text{ Denier Spread} \leqq 0.11(\text{denier/filament})+0.76,$$

wherein the boil-off shrinkage is about 25% or more.

3. The yarn of claim 1, wherein the filaments are of denier per filament between about 0.85 to less than 4.

4. The yarn of claim 2, wherein the filaments are of denier per filament between about 0.85 to less than 4.

* * * * *